United States Patent [19]

Wax et al.

[11] 4,017,368

[45] Apr. 12, 1977

[54] PROCESS FOR ELECTROPLATING ZIRCONIUM ALLOYS

[75] Inventors: Daniel E. Wax; Robert L. Cowan, II, both of Livermore, Calif.

[73] Assignee: General Electric Company, San Jose, Calif.

[22] Filed: Nov. 11, 1974

[21] Appl. No.: 522,767

[52] U.S. Cl. ..... 204/32 R; 156/656; 252/79.3; 252/142

[51] Int. Cl.[2] ..... C25D 5/34

[58] Field of Search ..... 117/49, 50; 134/3, 41; 204/23–27, 28, 29, 32 R, 140, 141.5; 252/79.3, 142; 156/18, 20; 427/307, 309, 327, 328

[56] References Cited

UNITED STATES PATENTS

| | | | |
|---|---|---|---|
| 2,646,396 | 7/1953 | Dean | 204/32 R |
| 2,711,364 | 6/1955 | Beach | 252/79.3 X |
| 3,125,474 | 3/1964 | Watkins et al. | 156/18 |
| 3,264,219 | 8/1966 | McGrew et al. | 252/79.3 |
| 3,725,217 | 4/1973 | Hartshorn | 148/6.14 R X |
| 3,761,313 | 9/1973 | Entwisle et al. | 134/3 |
| 3,817,844 | 6/1974 | Kendall | 204/32 R X |

*Primary Examiner*—William A. Powell
*Attorney, Agent, or Firm*—Ivor J. James, Jr.; Sam E. Laub; Samuel E. Turner

[57] ABSTRACT

A novel aqueous electrolytic activating solution and a method for electroplating zirconium and zirconium alloys are disclosed. The novel aqueous electrolytic activating solution is comprised of from about 10 to about 20 grams per liter of ammonium bifluoride ($NH_4FHF$) and from about 0.75 to 2 grams per liter of sulfuric acid ($H_2SO_4$).

8 Claims, No Drawings

PROCESS FOR ELECTROPLATING ZIRCONIUM ALLOYS

BACKGROUND OF THE INVENTION

This invention relates broadly to an improvement of electrolytic activating solutions useful for treating zirconium and zirconium alloys (hereinafter collectively referred to as zirconium) prior to electroplating a plateable metal layer on the zirconium and to a related electroplating process for zirconium.

It is well-known that zirconium and zirconium-base alloys and particularly those alloys used in nuclear reactors as cladding materials or in the fabrication of pressure tubes, have limited applications due to the corroding action of the coolants, generally, pressurized water, carbon dioxide, terphenyl or steam. Furthermore, the fabrication of such alloys is difficult and costly because of the rapid corrosion in air at temperatures about 800° to 900° C.

A zirconium oxide film of low ductility is formed on the surface of zirconium during fabrication. This film has a tendency to thicken and to eventually scale off. Simultaneously with the thickening and scaling off of the zirconium oxide film, oxygen penetrates into the subjacent metal and causes these areas to become brittle. This phenomenum is even more pronounced as the temperature of the zirconium is increased.

To protect zirconium against such corrosion, it has been proposed that it be protected by coatings for which various coating processes have been developed. Different metals have been tried as a coating material including aluminum, copper, nickel, and iron. However, the deposition techniques have been inefficient, particularly where the metals are submitted to a high temperature during either utilization or transformation. The primary defects of the prior deposition techniques include unevenness or great thickness of the coating and the lack of adherence or adhesion of the coating, particularly when hot. Also the maximum temperature at which the coatings may be used may be inadequate and limited because of the diffusion between the zirconium and the coating itself or due to the formation of fusible eutectics or both.

The depositing of metal layers on zirconium pieces had been tried by various processes with limited success. The deposits resulting from the electroplating comprise spaced apart modules of metal which require the coating to be thick if it is to be continuous due to the progressive surface increase of the modules and their bonding. Moreover, even when a continuous outer coating was obtained, the coatings had inherent defects of adhesion particularly at high temperatures. Accordingly these electrolytically plated zirconium pieces have a tendency to blister and thus fail to protect the zirconium, particularly when the zirconium is subjected to deformation.

A process in the plating of zirconium with chrome is disclosed in U.S. Pat. No. 3,502,549 in which the zirconium is electrolyzed in an aqueous electroyltic bath of from 400 to 500 grams per liter of chromium trioxide, 10 to 40 grams per liter of strontium sulfate and 30 to 80 grams per liter of $K_2SiF_6$ with a current density of from 5 to 40 A./dm$^2$ in the presence of a lead-base alloy anode, stirring the bath and maintaining the temperature of the bath between 10° and 30° C.

U.S. Pat. No. 3,368,951 discloses a nickel plating process for a zirconium or thorium substrate from a nickel plating bath which is an aqueous solution consisting essentially of from about 20 to about 50 grams per liter nickel sulfate, from about 6 to about 12 grams per liter zirconium sulfate, from about 10 to about 30 grams per liter sodium hypophosphate, from about 10 to about 30 grams per liter sodium acetate and from about 10 to about 30 per liter sodium citrate. Following cleaning the metal is immersed in the metal plating bath which is maintained between 85° and 100° C with application of a D.C. voltage of from about 1 to about 5 volts between an anode and the zirconium or thorium substrate.

In the Journal of Electrochemical Society, Volume 100, page 289 (1953), there is a disclosure that a molar ratio of 1.2 to 4.1 of $NH_4F/HF$ provided good adhesion of electroplatings on zirconium and this is believed due to the formation of zirconium hydrides to give electronic conductivity required for plating. An aqueous activating solution of 29 grams of KF and 50 grams of HF was reported to give good results in Energia Nucleare, Volume 11, page 505 (1964), In Memoires Scientifique Rev. Metallurg., Volume 63, page 1 (1966), there is a report that Zircaloy can be activated anodically for copper and nickel platings in an aqueous bath of 50% HCL, 10% Glycerine, 0.5% butanediol and a wetting agent. Another anhydrous eutectic solution is disclosed comprised of 41% LiCl, 49% KCl, and 10% $CuCl_2$ at 400° to 500° C.

While the foregoing have produced coatings on zirconium, it has remained desirable to achieve even more improved electroplating processes for zirconium.

SUMMARY OF THE INVENTION

It has now been discovered that zirconium and zirconium alloys can be electroplated with a metal layer such as a metal selected from the group consisting of copper, nickel and chromium by activating the zirconium and zirconium alloys in an aqueous electrolytic activating solution of from about 10 to about 20 grams per liter of ammonium bifluoride ($NH_4FHF$) and from about 0.75 to about 2 grams per liter of sulfuric acid ($H_2SO_4$) at 25° C, followed by electrolyzing the zirconium material in a salt bath of the metal to be plated on the zirconium material with the application of electrical energy. This invention also includes a novel aqueous electrolytic activating solution of from about 10 to about 20 grams per liter of ammonium bifluoride and from about 0.75 to about 2 grams per liter of sulfuric acid.

OBJECTS OF THE INVENTION

It is an object of this invention to provide a novel aqueous electrolytic activating solution useful for the plating of zirconium materials.

Another object of this invention is to provide a process for activating zirconium materials for plating so that the zirconium materials can be plated immediately or stored for later plating.

Another object of this invention is to provide a process for activating zirconium for plating so that with a proper out gassing treatment after the plating process the plated zirconium alloy can be used at elevated temperatures of about 500° to about 750° F (about 260° to about 399° C) without blistering or delamination.

Other objects and advantages of this invention will become apparent to a person skilled in the art from eading the following description of this invention and ne appended claims.

DETAILED DESCRIPTION OF THE INVENTION

The foregoing objects have been accomplished in a ew process for electroplating zirconium with a metal elected from the group consisting of copper, nickel, nd chromium. The first step involves contacting the irconium material with an aqueous electrolytic acti- ating solution comprised of from about 10 to about 20 rams per liter ammonium bifluoride, preferably about 5 grams per liter ammonium bifluoride and from bout 0.75 to about 2 grams per liter of sulfuric acid, referably about 0.95 grams per liter sulfuric acid, hich solution has been aged by immersion of a piece f pickled zirconium for about 10 minutes at ambient emperature. Following the activation step, the zirco- ium material is electrolyzed in a salt bath of the metal o be plated on the zirconium material with the applica- ion of an electric current density in the range of about to about 40 A./dm$^2$. During the electrolyzing step, the alt bath is agitated.

Preferred metals to be plated upon the zirconium naterial include copper, nickel and chromium. When opper is plated on zirconium, an aqueous bath of the ollowing composition has been employed: copper sul- ate ($CuSO_4$)—250 grams/liter, sulfuric acid ($H_2SO_4$)- 0 grams/liter, ethanol ($C_2H_5OH$)—10 grams/liter with he balance water. The plating bath is agitated and naintained at ambient temperature of about 65°–75° F about 18°–24° C). A current density of about 1.5 Amps/Square decimeter is employed with a copper node. However any other conventional plating pro- esses can be used. This procedure produces a very ood as-plated adherence with no porosity. To insure hat the plating can be used at elevated temperatures of 00° to 750° F (260° to 399° C) without loss of adhe- ion, the plated zirconium is out gassed at 300° to 400° (149° to 204° C) at a rate of about 50° F to 125° F per our.

For plating nickel on zirconium, an aqueous bath of he following composition is employed: nickel sulfate $NiSO_4.6H_2O$)—330 grams/liter, nickel chloride $NiCl_2.6H_2O$)—45 grams/liter, boric acid ($H_3BO_3$)-85 rams/liter with the balance water. The plating bath is gitated and maintained at 115°–160° F (48°–72° C) sing a current density of 5 Amps/square decimeter ith a nickel anode. However, any other conventional ickel plating process can be used. This production roduces a very good as-plated adherence with no orosity. To insure that the plating can be used at ele- ated temperatures, the same outgassing procedure mployed above for copper is used.

For plating chromium on zirconium, a bath of the ollowing composition is employed: chromic oxide $CrO_3$)—283 grams/liter, sulfuric acid ($H_2SO_4$)—2.83 rams/liter with the balance water. The plating bath is gitated and maintained in the temperature range of 40° to 158° F (60° to 70° C) using a current density of 5 amps/square decimeter. A platinized titanium lead r stainless steel anode may be used. Any other con- entional chromium plating process can be used. The hromium plated zirconium alloy is subjected to the hermal outgassing cycle described above for copper lating.

The sample to be electroplated is exposed to the queous electrolytic activating solution for about 1 ninute at ambient temperatures (approximately 22°–30° C) with agitation prior to plating. The sample is then rinsed in water, and can be immediately plated or stored for several days before plating is initiated.

Utilizing the foregoing method and the aqueous electrolytic activating solution, it is possible to obtain a continuous deposit of the metal to be plated on zirconium with a minimum thickness of about 1.5 microns or greater. For best results it is preferred to have a thickness of from about 3 to about 15 microns plated on the zirconium material, and it is possible to utilize even thicker coatings with the foregoing process. Plated coatings achieved by the foregoing process protect the zirconium against most of the usual agents brought into contact with it at high temperatures including oxygen, air, water, steam and fission products produced in nuclear fuel elements during nuclear fission.

After the plating it is possible to subject the metal coatings on the zirconium to various treatments including diffusion annealing treatments or plating of a second metal.

The following non-limiting examples illustrate the results obtained in the practice of this invention to achieve coatings upon zirconium materials.

EXAMPLE 1

Using the activation technique and the copper plating procedure described above, the inside surface of Zircaloy-2 tubes 3 feet long and 0.485 inches in internal diameter was plated with a uniform layer of copper, with some tubes having a thickness of 0.0002 inches and some tubes having a thickness of 0.0004 inches. The copper anode was located centrally in the tube and was electrically insulated from the tube. The activating solution was pumped through the tube for one minute, then rinse water was pumped through the tube and then the plating solution was pumped through the tube while the application of a current density of 1.5 amps/square decimeter for 15.2 minutes (for the thickness of 0.0002 inches) and 30.4 minutes (for the thickness of 0.0004 inches) respectively. The tube was then rinsed and outgassed. A bright, level, uniform copper deposit resulted and metallographic sectioning showed the deposit to be adherent and uniform on a microscopic level. The tube could be plastically deformed and the copper deposit was still adherent. Exposing the tube to inert gas at 650° and 1070° F did not result in splitting or blistering of the copper. Exposure to steam at 750° F gave no splitting or blistering of the copper.

EXAMPLE 2

Using the activation technique and the nickel plating procedure described above, the inside surface of a Zircaloy-2 tube 3 feet long and 0.485 inch in internal diameter was plated with a uniform layer of nickel 0.0002 inches in thickness by applying the suggested current for 4.5 minutes. A nickel anode and the nickel plating solution were employed and the same general procedure outlined in Example 1 was followed. A bright, level uniform nickel deposit resulted. Metallographic sectioning showed the plating to be uniform in thickness and adherent at a microscopic level. The tube could be plastically deformed and the nickel deposit remained adherent. Exposing the tube to inert gas at 650° and 1070° F did not result in splitting or blistering of the nickel coating. Exposure to steam at 750° F gave no splitting or blistering of the nickel.

EXAMPLE 3

Using the activation technique and the chromium plating procedures described above, the inside surface of a Zircaloy-2 tube 3 feet long and 0.485 inch in diameter was plated with a uniform chromium layer of 0.0001 inch in thickness. The suggested current was applied for 1 hour. A platinized titanium anode and the chromium plating solution set forth above were employed and the same general procedure outlined in Example 1 was followed giving a bright, level uniform chromium deposit. Metallographic sectioning showed the plating to be uniform in thickness and adherent at a microscopic level. The deposit could be scratched with a hard pointed steel stylus without chipping or galling. Exposing the tube to inert gas at 650° and 1070° F did not result in any blistering or splitting. Exposure to 750° F steam gave no blistering or splitting.

As will be apparent to those skilled in the art, various modifications and changes may be made in the invention described herein. It is accordingly the intention that the invention be construed in the broadest manner within the spirit and scope as set forth in the accompanying claims.

What is claimed is:

1. An aqueous electrolytic activating solution comprised of a. from about 10 to about 20 grams per liter of ammonium bifluoride, and b. from about 0.75 to about 2 grams per liter of sulfuric acid, said solution having been aged by immersion of zirconium therein.

2. An aqueous electrolytic activating solution according to claim 1 and having about 15 grams per liter of ammonium bi-fluoride and about 0.95 grams per liter sulfuric acid.

3. An aqueous electrolytic activating solution according to claim 1 which has been aged by immersion of pickled zirconium for about 10 minutes at ambient temperature.

4. A method for protecting zirconium and zirconium base alloys by electrolytic deposition of a metal film thereon, comprising a. activating the zirconium and zirconium alloys in an aqueous electrolytic activating solution of from about 10 to about 20 grams per liter of ammonium bi-fluoride and from about 0.75 to about 2 grams per liter of sulfuric acid, said solution being aged by immersion of pickled zirconium in said solution for about 10 minutes, and b. electroplating the zirconium material in a plating bath of the metal to be plated on the zirconium material.

5. A method according to claim 4 in which the aqueous electrolytic activating solution is comprised of about 15 grams per liter ammonium bi-fluoride and about 0.95 grams per liter sulfuric acid.

6. The method according to claim 4 in which the salt bath is copper sulfate and the metal to be plated on the zirconium material is copper.

7. The method according to claim 4 in which the salt bath is nickel sulfate and the metal to be plated on the zirconium material is nickel.

8. The method according to claim 4 in which the salt bath is chromium oxide and the metal to be plated on the zirconium material is chromium.

* * * * *